United States Patent [19]

Hoback

[11] Patent Number: 4,655,064

[45] Date of Patent: Apr. 7, 1987

[54] ROTARY CRIMPING TOOL

[75] Inventor: Gregory K. Hoback, Aurora, Colo.

[73] Assignee: HoseCo, Inc., Arvada, Colo.

[21] Appl. No.: 803,240

[22] Filed: Dec. 2, 1985

[51] Int. Cl.[4] ..... B21D 17/04

[52] U.S. Cl. ..... 72/35; 72/121; 72/126

[58] Field of Search ..... 72/35, 110, 111, 120, 72/121, 124, 126, 211; 81/DIG. 5

[56] References Cited

U.S. PATENT DOCUMENTS

| | | | |
|---|---|---|---|
| 669,742 | 3/1901 | Dudly | 81/DIG. 5 |
| 2,337,362 | 12/1943 | Willinger | 72/121 |
| 2,711,771 | 6/1955 | Wilson | 72/126 |
| 2,975,819 | 3/1961 | Costanzo et al. | 72/124 |
| 3,071,993 | 1/1963 | Foster et al. . | |
| 3,283,553 | 11/1966 | Taylor . | |
| 3,316,744 | 5/1967 | Spangler | 72/35 |
| 3,867,824 | 2/1975 | Takagi et al. . | |

FOREIGN PATENT DOCUMENTS

| | | | |
|---|---|---|---|
| 1441404 | 5/1966 | France | 72/121 |

*Primary Examiner*—Lowell A. Larson

*Attorney, Agent, or Firm*—Fields, Lewis, Pittenger & Rost

[57] ABSTRACT

The problem of hose breakdown in the field is solved by a hand-held crimping tool according to the present invention. The crimping tool disclosed has a frame with two leg portions projecting out from the ends. A crimping die roller including two arcuate ridges separated by an arcuate groove co-operates with two spaced rollers that move with a carriage. The carriage is advanced and retracted by a threaded shaft. The crimping die roller is supported on one leg portion and a threaded shaft on the other leg that moves the carriage. A pre-calibrated crimp measuring means on the tool provides the exact amount of crimp for each fitting and hose.

9 Claims, 9 Drawing Figures

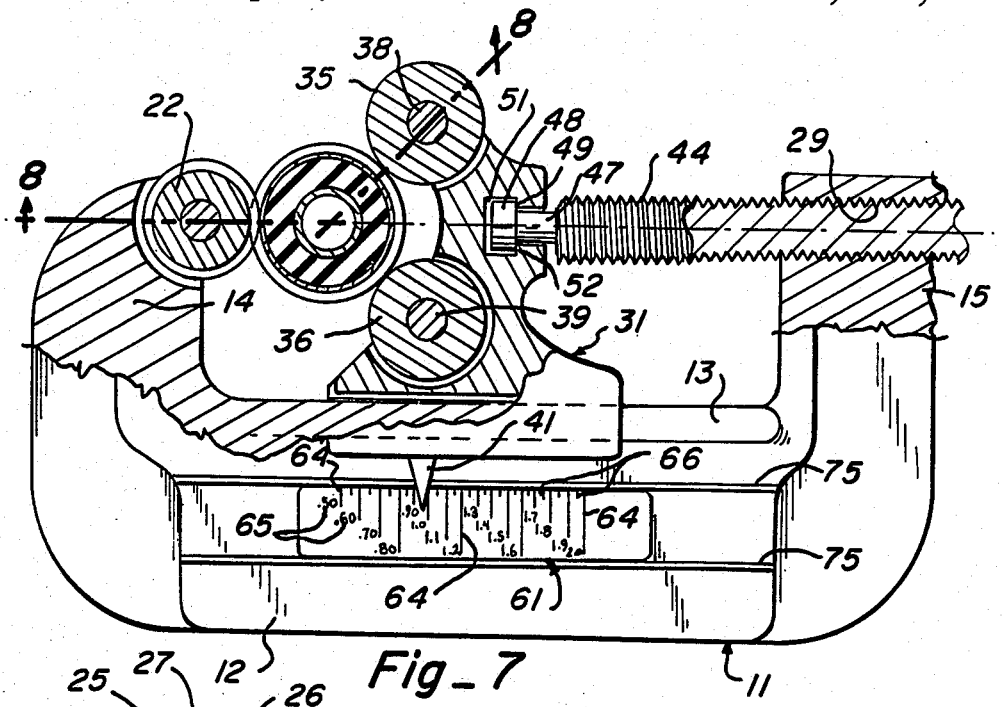
Fig_7
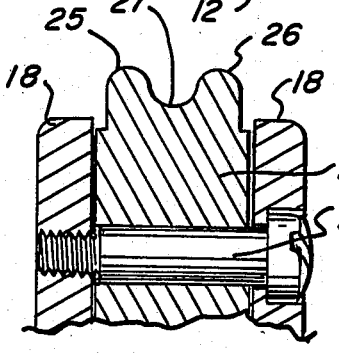
Fig_6
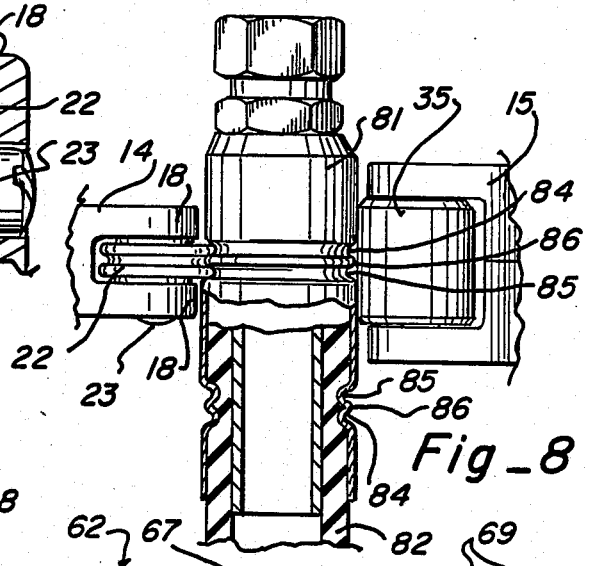
Fig_8
Fig_5
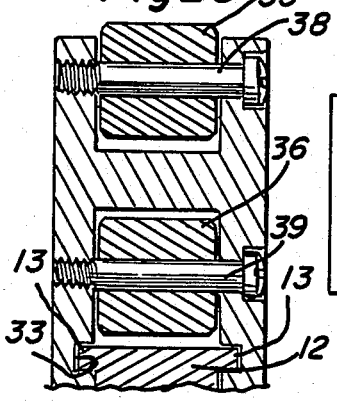
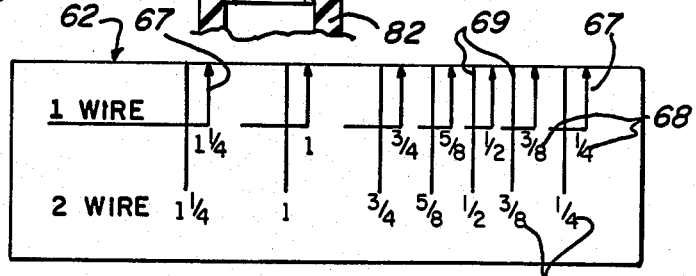
Fig_9

ROTARY CRIMPING TOOL

TECHNICAL FIELD

This invention relates to a novel and improved tool for crimping metal tube fittings to secure the fittings to flexible tubing or hoses and form a fluidtight joint.

BACKGROUND ART

The use of flexible hoses or tubing in fluid pressure systems and particularly high pressure hydraulic systems is widespread. Such used include agricultural vehicles, printing presses, industrial vehicles, and fire department vehicles.

The current practice for joining high pressure fittings to flexible tubing is to use a shop tool. This practice requires a relatively large hydraulic press and split dies.

There are many in the field or on site circumstances where a break in the hydraulic hose shuts down the operation of an important piece of equipment and a replacement hose is not readily available.

Some attempts have been made to provide portable hand-held tools for this purpose but these have not been entirely satisfactory, particularly for high pressure hose applications such as those that carry as for example 20,000 psi.

Foster, U.S. Pat. No. 3,071,993 discloses a frame with spaced rollers opposite a single groove forming roller that is mounted on a threaded shaft moved by turning a knob.

Taylor, U.S. Pat. No. 3,283,553 discloses a roller arrangement on a hand tool wherein a number of different roller peripheral shapes are used according to the required task.

Takagi et al, U.S. Pat. No. 3,867,824 discloses a groove-rolling roll in which there is a perpheral peak with valleys on either side for use with spaced rollers arranged opposite the groove-rolling roll.

DISCLOSURE OF INVENTION

A rotary crimping tool for securing a tube fitting to a tube or hose disclosed includes a frame having a main body portion and two outwardly projecting leg portions with a crimping die roller including two rounded ridges separated by a rounded groove supported by one of the leg portions. A pair of spaced rollers are disposed opposite the said crimping die roller on a carriage movable relative to the frame. A threaded shaft on the other leg portion is connected to the carriage to move the carriage to force the crimping die roller into engagement with a tube fitting as the frame is rotated around the fitting and the pair of rollers are advanced to effect the crimping of the tube fitting against said tube. Pointers movable with the carriage and operable with an associated calibrated scale on the frame co-operate to provide a dimensional relation to rotary movement to give the correct amount of crimp for the particular size of tube and tube fitting being joined without resorting to separate charts.

BRIEF DESCRIPTION OF DRAWINGS

The details of this invention will be described in connection with the accompanying drawings, in which:

FIG. 5 is a sectional view taken along lines 5—5 of FIG. 4;

FIG. 6 is a sectional view taken along lines 6—6 of FIG. 5;

FIG. 7 is an enlarged fragmentary side elevational view of the tool shown in FIG. 1 showing one calibrated scale;

FIG. 8 is a sectional view taken along lines 8—8 of FIG. 7; and

FIG. 9 is an enlarged view of the other calibrated scale.

DETAILED DESCRIPTION

Figure 1:
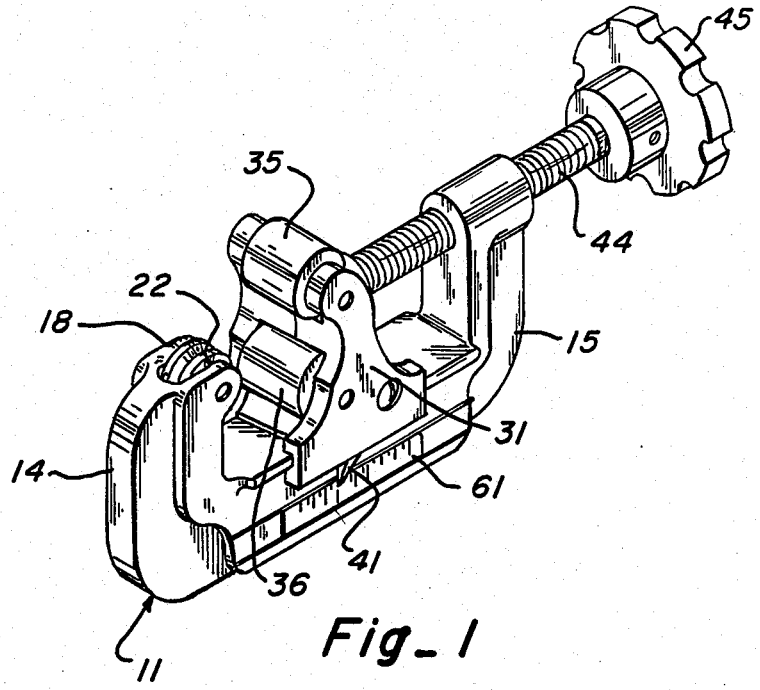
FIG. 1 is a perspective view of an embodiment of a crimping tool in accordance with the present invention.
Figure 2:
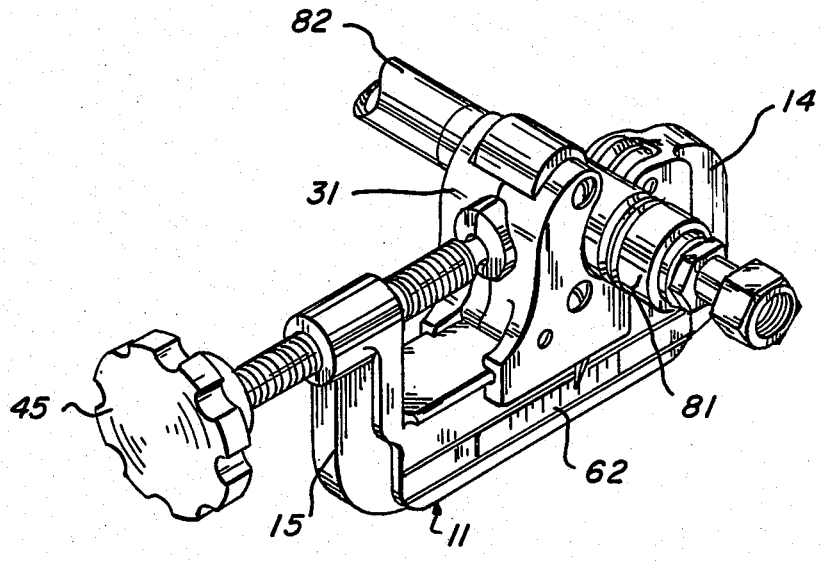
FIG. 2 is a perspective view of the tool shown in FIG. 1 that has been turned end-for-end with a tube fitting and hose positioned between the crimping rollers for crimping.
Figure 3:
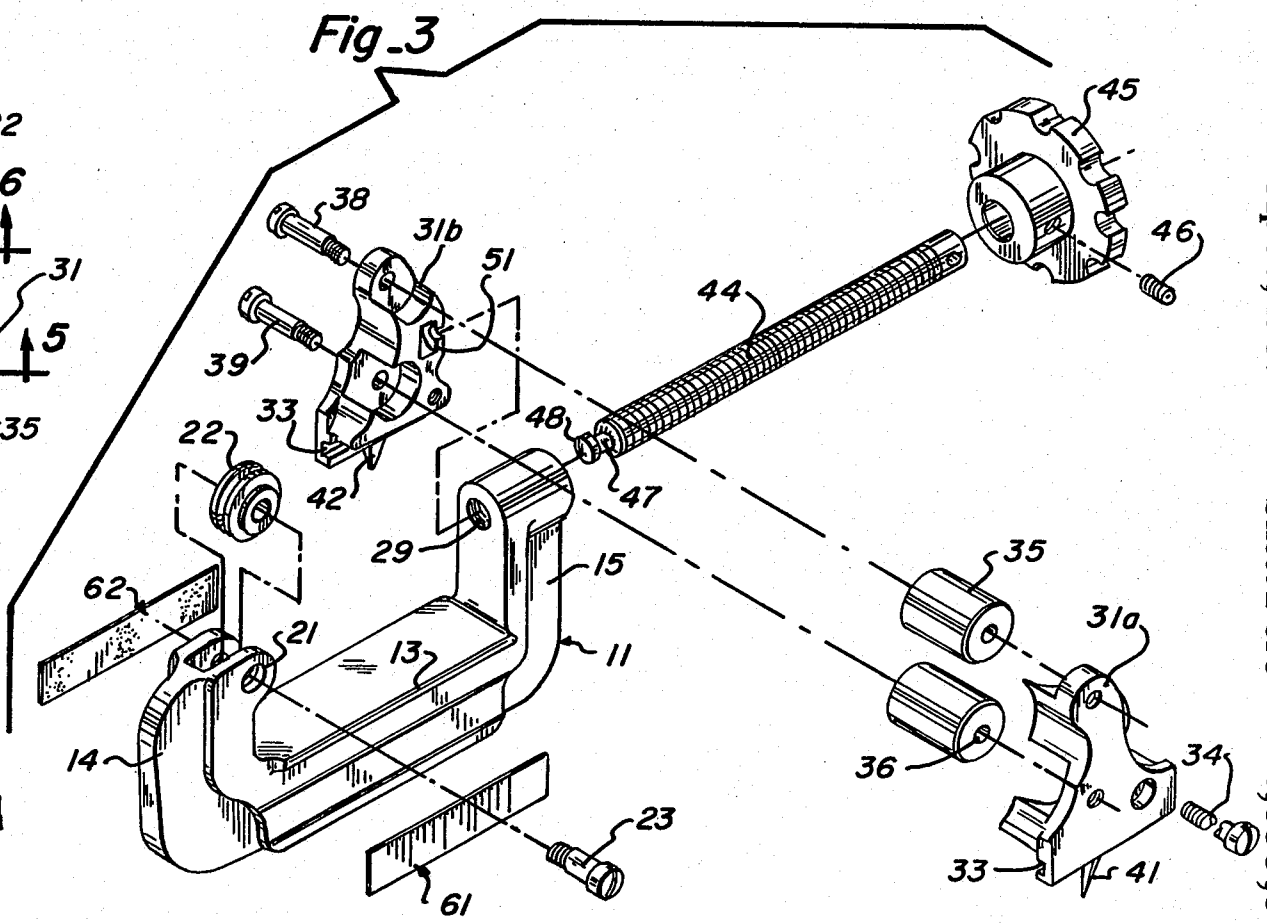
FIG. 3 is an exploded view of the tool shown in FIG. 1.
Figure 4:
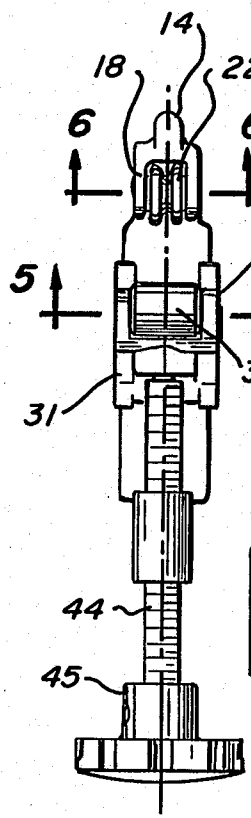
FIG. 4 is a top plan view of the tool shown in FIG. 1.

Referring now to the drawings, there is shown a rotary crimping tool which comprises a unitary, generally C-shaped frame 11 including a main body portion 12 having opposite lateral flanges 13 extending in opposite directions along the top, and two leg portions 14 and 15 extending from opposite ends of the main body portion in a generally transverse relation thereto.

Preferably, this frame is made as an integral cast aluminum body. The leg portion 14 has an inturned bifurcated portion at the upper end with spaced lugs 18, having alined holes 21 therein. A crimping die roller 22 is held for free rotary movement between the lugs 18, and by a fastener in the form of a shoulder screw 23 that extends through the roller and the alined holes 21.

The crimping die roller is constructed with two convex ridges 25 and 26 having an arcuate surface formed along a preselected radius, separated by a concave groove 27 hving an arcuate surface formed along a preselected radius. Each radius is preferably on the order of a 0.035 inch. This roller shape forms two grooves in the fitting and this with the radiused shape provides a very strong joint that will withstand high pressures. Further, the roller will not slip or walk during the use thereof.

A carriage 31 is mounted on the frame for sliding movement between extended and retracted positions. This carriage has oppositely disposed grooves 33 in which the lateral flanges 13 extend to retain the carriage for sliding movement between the ends of the main body portion of the frame. This carriage is constructed of two half-sections **31*a* and 31*b* which are held together by a shoulder screw 34 for ease of assembly and disassembly. Half section 31*a* carries a pointer 41 and half section 31*b* carries a pointer 42. Two movable rollers 35 and 36 are mounted for free rotary movement in recesses in the carriage so that these rollers will move toward and away from the crimping die roller. In particular, a shoulder screw 38 extends through alined apertures in the carriage to hold the roller 35 in the carriage and a shoulder screw 39 extends through alined apertures in the carriage. Rollers 35 and 36** are of a corresponding size and shape and have a uniform diameter and a smooth peripheral surface.

Leg portion 15 has a longitudinal bore 29 with internal threads disposed opposite the crimping die roller 22. An externally threaded shaft 44 is threadably received in the bore 29 and has a hand knob 45 at the free end held thereon by a set screw 46. An annular groove 47 is formed in the shaft opposite the knob 45. This provides a head portion 48 at the inner end of the shaft and a shoulder 49 fitted within a stepped bore 51 with a shoulder 52 formed in the carriage to connect the inner end of the shaft to the carriage so that upon rotation of the shaft in one direction, the carriage and spaced movable rollers are moved toward roller 22 and upon rotation in the opposite direction, the rollers move away from roller 22.

The pointer 41 operates in association with calibrated scale 61 which extends along one side of the main body portion. Similarly, a pointer 42 operates in association with calibrated scale 62 on the opposite side of the main body portion. These pointers and associated calibrated scales are a pre-calibrated crimp measuring means which indicate to the user that the correct amount of groove or crimp has been made in a particular size of tube and tube fitting.

Scale 61 has a series of equally spaced lines 64 that are marked with numeral indicia 65 indicating the external diameter sizes for the crimp or groove 84 measured in inches. The lines 64 are successively marked from 0.5 inches to 2.0 inches in equal increments. Intermediate lines 66 are provided between marked lines 64. When a hose is being fitted to the fitting the movable rollers are advanced until the pointer 61 is moved into alinement with the desired line 64 thereby forming the desired groove diameter for the particular hose and fitting being joined.

Each of the scales shown is made as a decal with an adhesive that secures it to the side of the frame. Preferably, top and bottom ridges 75 are formed in the sides of the frame to indicate the correct location for the decal.

Scale 62 has a series of equally spaced lines 67 marked with numeral indicia 68 corresponding to hose dimensions for one wire braid hose. The numeral indicia marked on lines 67 corresponding to hose dimensions in inches are: ¼, 154 , 178 , 158 , 182 , 1, and 1¼.

Scale 62 further has a series of equally spaced lines 69 marked with numeral indicia 70 for two wire braid hose using the same hose dimensions as are above listed for lines 67.

In using the tool, a flexible hose or tube fitting 81 is placed over the end portion of the hose or tube 82 and the assembly placed between the roller 22 opposite spaced rollers 35 and 36. The fitting 81 shown is more specifically referred to in the trade as a hose coupling. The threading knob 45 is turned to turn the shaft 44, until the rollers bear against the smooth cylindrical section of the fitting. The shaft 44 is further rotated and at the same time the tool is rotated around the fitting with the ridges and groove in the crimping die roller forming grooves 84 and 85 separated by a ridge 86 being imprinted in the peripheral surface of the fitting. The knob is further turned so that the crimp or groove deepens, and the advancement is made until the pointers 61 or 62 comes into alinement with the correct line on the scale which indicates to the operator that for a particular hose dimension or a particular groove dimension the correct crimp has been accomplished. This forms a fluid-tight joint between the fitting and hose which has been found to be effective in the hoses that are subjected to 24,000 psi.

Although the present invention has been described with a certain degree of particularity, it is understood that the present disclosure has been made by way of example and that changes in details of structure may be made without departing from the spirit thereof.

What is claimed is:

1. A crimping tool for securing a hose coupling to a non-metallic flexible hose to form a fluid-tight joint comprising:

a frame having a main body portion and two leg portions extending generally transversely from opposite ends of said main body portion;

first roller means in the form of a crimping die roller having two arcuate ridges separated by an arcuate groove, said groove extending radially inwardly from the base of said ridges, said ridges and groove having substantially the same radius;

second roller means disposed opposite said first roller means;

one of said first and second roller means being supported on a carriage movable relative to said frame for movement toward and away from the other of said roller means, said other of said roller means being supported by one of said leg portions;

means on the other of said leg portions to move said carriage and one roller means toward the other of said roller means to force said crimping die roller into engagement with a hose coupling on a hose between said first and second roller means as said frame is rotated around said coupling and said one roller means is advanced to effect the crimping of said hose coupling against said hose and form a fluid-tight joint; and pre-calibrated crimp measuring means including a first pointer carried by said carriage and a first calibrated scale extending along one side of said main body portion that alines with said pointer to indicate the correct limit of movement for said one roller means to provide the correct amount of crimp for the particular size and type of hose and hose coupling being joined and a second pointer carried by said carriage and a second calibrated scale extending along the other side of said main body portion that aligns with said second pointer to provide the correct amount of crimp for a range of user selected hose sizes and hose couplings being joined.

2. A crimping tool as set forth in claim 1 wherein said frame is made as one-piece cast aluminum body.

3. A crimping tool as set forth in claim 1 wherein said carriage is made as two half-sections secured together by releasable fastening means.

4. A crimping tool as set forth in claim 1 wherein said frame and carriage have pairs of complementary grooves and flanges to retain said carriage for sliding movement on said frame.

5. A crimping tool as set forth in claim 1 wherein said means to move said carriage includes a threaded shaft threaded into a bore in said other leg portion and connected at the inner end to said carriage and having a knob at the outer end.

6. A crimping tool as set forth in claim 1 wherein said calibrated scale means has lines with number indicia indicating external diameters of the groove for a particular hose size.

7. A crimping tool as set forth in claim 1 wherein said calibrated scale means has lines and number indicia indicating hose sizes for both a one-wire braid and a two-wire braid.

8. A crimping tool for securing a hose coupling to a non-metallic flexible hose to form a fluid-tight joint comprising;

a frame having a main body portion and two leg portions extending generally transversely from opposite ends of said main body portion;

first roller means in the form of a crimping die roller having two arcuate ridges of a preselected radius separated by an arcuate groove of a preselected radius, said groove extending radially inwardly from the base of said ridges, said ridges and groove having substantially the same radius;

second roller means disposed opposite said first roller means;

one of said first and second roller means being supported on a carriage movable relative to said frame for movement toward and away from the other of said roller means, said other of said roller means being supported by one of said leg portions;

means to move said carriage and one roller means toward the other of said roller means to force said crimping die roller into engagement with a hose coupling on a hose between said first and second roller means as said frame is rotated around said fitting and as said one roller means is advanced to effect the crimping of said hose coupling against said tube and form a fluid-tight joint.

9. A portable hand-held rotary crimping tool for securing a hose coupling to a non-metallic flexible hose to form a fluid-tight joint comprising:

a unitary frame including a main body portion having opposite lateral flanges extending along the top in opposite directions, and first and second leg portions extending generally transversely from opposite ends of said main body portion;

said first leg portion having a bifurcated portion with spaced lugs having aligned apertures therein carrying a crimping die roller, said crimping die roller including two arcuate ridges separated by an arcuate groove, said groove extending radially inwardly of the base of said ridges, said ridges and groove having substantially the same radius;

said second leg portion having a longitudinal bore with internal threads;

a carriage having opposed grooves into which said lateral flanges extend to be retained for sliding movement along said main body portion between the ends thereof, said carriage being constructed of separable body half sections held together by a releasable fastener;

two spaced movable rollers mounted on said carriage, for movement toward and away from said first roller;

an externally threaded shaft threadably received in said bore and having a hand knob at the free end and connected to said carriage to move said carriage and two movable rollers toward said crimping die roller to force said crimping die into engagement with said hose coupling as said frame is rotated around said hose coupling and said two rollers are further advanced to effect a crimping and form a fluidtight joint;

indicator means including a first pointer movable with said carriage and an associated first calibrated scale extending along the side of said main body portion to indicate the limit of movement to provide the correct amount of crimp for a particular size and type of hose and hose coupling and a second pointer carried by said carriage and a second calibrataed scale extending along the other side of said main body portion that aligns with said second pointers to provide the correct amount of crimp for a range of user selected hose sizes and hose couplings being joined.

* * * * *